United States Patent [19]

Morrison

[11] Patent Number: 4,458,570

[45] Date of Patent: Jul. 10, 1984

[54] SHEET MATERIAL DISPENSER

[75] Inventor: Howard J. Morrison, Deerfield, Ill.

[73] Assignee: Marvin Glass & Associates, Chicago, Ill.

[21] Appl. No.: 342,514

[22] Filed: Jan. 25, 1982

[51] Int. Cl.[3] ..... B65D 85/671

[52] U.S. Cl. ..... 83/375; 83/611; 83/650; 225/43; 225/91

[58] Field of Search ..... 83/649, 650, 610, 611, 83/382, 622, 636, 375; 225/34, 43, 91; 242/55.3, 55.53

[56] References Cited

U.S. PATENT DOCUMENTS

| | | | |
|---|---|---|---|
| 21,657 | 10/1858 | David | 83/622 |
| 2,992,582 | 7/1961 | Castelli | 83/649 X |
| 3,762,261 | 10/1973 | Ekenberg | 225/43 X |
| 3,771,401 | 11/1973 | Jasinski | 83/622 X |
| 4,196,647 | 4/1980 | Fish | 83/649 X |
| 4,218,946 | 8/1980 | Witzler | 83/636 |
| 4,352,309 | 10/1982 | Thalström et al. | 83/622 X |

*Primary Examiner*—Frank T. Yost

[57] ABSTRACT

A dispenser for sheet material includes a housing defining at least one compartment for holding a continuous roll of sheet material. A cover for the compartment, pivotally mounted on the housing, includes a cutting edge located near its free end. The housing includes a member for holding the sheet material being cut.

15 Claims, 6 Drawing Figures

SHEET MATERIAL DISPENSER

BACKGROUND OF THE INVENTION

1. Field of the Invention

The present invention relates to a new and improved dispenser for dispensing and cutting sheet material and the like.

2. Description of the Prior Art

In the prior art there are several types of dispensers for dispensing and tearing or cutting desired lengths from a roll of sheet material such as aluminum foil or plastic wrapping film. Exemplary of this art are U.S. Pat. Nos. 2,657,873, 3,221,586, 3,542,268, 3,567,087, and 4,043,519. A typical prior art dispenser is a paper box in which is contained a roll of sheet material and a rigid tooth cutting edge is attached to the edge of the box. The sheet material is then unrolled to the desired length and torn across the rigid cutting edge. Such a dispenser often produces an uneven cutting or tearing of the sheet material or a ripping effect caused by pulling of the sheet material at the same time the cutting occurs. The box containing the sheet material often is not of sufficient strength to withstand the forces created by tearing the sheet material and often times collapses before the entire roll of sheet material has been used. In addition, these prior art dispensers often must be handheld while cutting or dispensing the sheet material making the cutting operation cumbersome and further increasing the risk of an uneven or ragged cut.

SUMMARY OF THE INVENTION

An object of the present invention is to provide a new and improved dispenser for cutting and dispensing a sheet of a desired length from a roll of sheet material.

Briefly, the present invention is directed to a new and improved dispenser for dispensing sheets of desired length from a roll of sheet material, such as aluminum foil or plastic wrapping film. The dispenser includes a housing defining at least one compartment within which may be positioned a roll of sheet material. The housing may be a permanent construction and capable of being attached to a wall or door. A cover is pivotally mounted on the housing and includes a cutting device such as cutting teeth thereon. The teeth in the preferred embodiment may be alternating long and short teeth or may be a triangular shaped serrated edge. The housing includes a wall or similar member for supporting and holding the sheet material during and after cutting by the cutting device.

BRIEF DESCRIPTION OF THE DRAWINGS

The above and other objects and advantages and novel features of the present invention will become apparent from the following detailed description of a preferred embodiment of the invention illustrated in the accompanying drawing wherein.

DESCRIPTION OF THE PREFERRED EMBODIMENT

Figure 1:
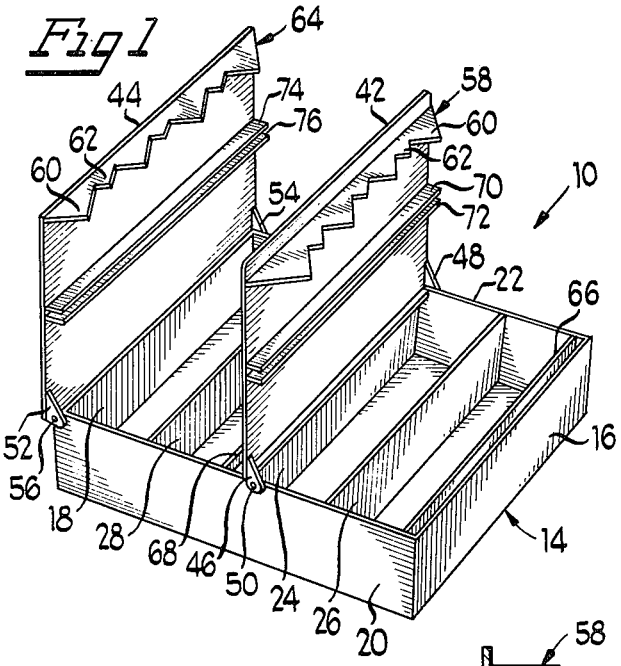
FIG. 1 is a perspective view of a dispensing device constructed in accordance with the principles of the present invention.
Figure 2:
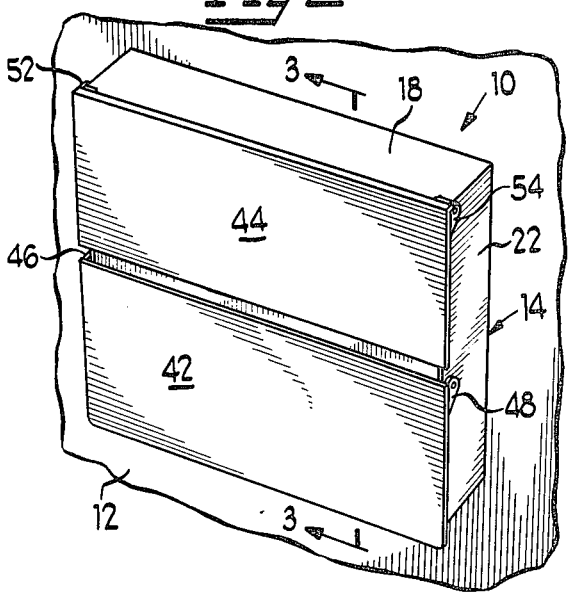
FIG. 2 is a view of the dispensing device of the present invention mounted on a wall or door.

Referring to the drawing, there is illustrated a dispensing device generally designated by the reference numeral 10 constructed in accordance with the principles of the present invention. The dispensing device 10, conveniently made by conventional plastic molding techniques, may be employed as a permanent dispenser for dispensing sheets of a desired length from one or more rolls of sheet material such as aluminum foil or plastic wrapping film. The dispensing device 10 may be placed on a counter as shown in FIG. 1 or mounted on the back on a door or wall 12 as shown in FIG. 2.

Figure 3:
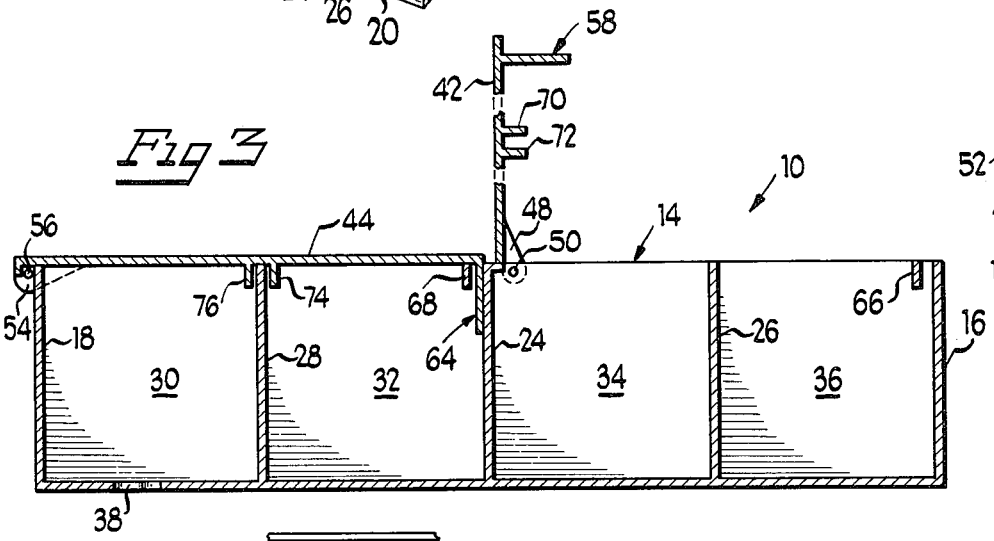
FIG. 3 is an enlarged partial cross-sectional view taken generally along the line 3—3 in FIG. 2, but showing one door in its full open position.
Figure 6:
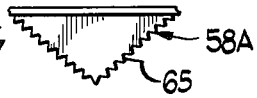
FIG. 6 is a view of another embodiment of a cutting device useful with the present invention.
Figure 4:
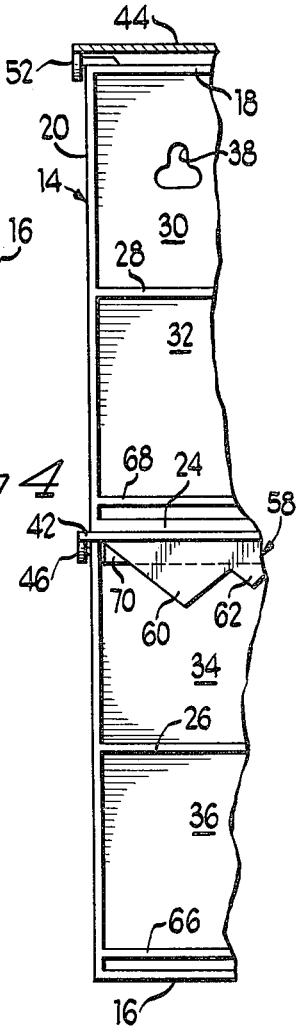
FIG. 4 is an enlarged, partial top view showing both doors open of the embodiment shown in FIG. 1.

As shown in FIG. 3, the dispenser 10 includes a generally rectangular housing 14 including a front wall 16, a rear wall 18, a first side wall 20 and a second side wall 22. A wall 24 divides the housing 14 into first and second compartments. In addition, the walls 26 and 28 divide each of the two compartments defined by the wall 24 into two more compartments resulting in four compartments 30, 32, 34 and 36. It should be understood, however, that any number of compartments may be provided through the employment of walls or partitions similar to walls 24, 26 and 28. There are defined in the bottom of the housing 14 apertures 38 that allow mounting of the housing 14 onto a wall or door 12. Rolls 40 of various types of sheet material may be positioned within the compartments 30, 32, 34 and 36 or Pivotally mounted on the housing 14 are first and second covers 42 and 44. The cover 42 includes extensions 46 and 48 that are mounted by pins 50. Similarly cover 44 is mounted to the housing 14 by extensions 52 and 54 and pins 56. In order to cut desired lengths of sheet material from either of the rolls 40 located in the compartments 34 and 36, a cutting edge 58, conveniently arranged generally perpendicularly to its cover 42 or 44, and generally parallel to its cover's axis of rotation is provided near the forward or free edge of the covers 42, 44. The cutting edge 58 conveniently includes alternating long 60 and short 62 teeth, as shown in FIGS. 1 and 4. The cutting edge 58 provided with staggered teeth 60 and 62 requires less pressure to be applied to the cover 42 to cut the sheet material on the rolls 40. This is due to the fact that initially the teeth 60 cut into the sheet material and once these teeth 60 have punctured the sheet material, the shorter teeth 62 start to puncture the sheet material, thus distributing the force required over two steps. In an alternative embodiment illustrated in FIG. 6, the cutting edge 58A may be triangular in shape having a serrated cutting surface 65.

A rib 66 extends between the side walls 20 and 22 of the housing 14 and is spaced slightly from the front wall 16 at the upper edge thereof. The cutting edge 58 upon, closing of the cover 42, extends between the front wall 16 and the rib 66. The rib 66 provides a pinching and holding surface against which the sheet of material is pinched and held during the cutting operation. This assures that the sheet material does not slip as pressure is applied to it upon placement of the cutting teeth 58 onto the sheet material, thus avoiding a ragged and uneven cut edge of the sheet material. A similar rib 68 is provided in the compartment 32 and cooperates with the teeth 64 in the same manner described above.

Figure 5:
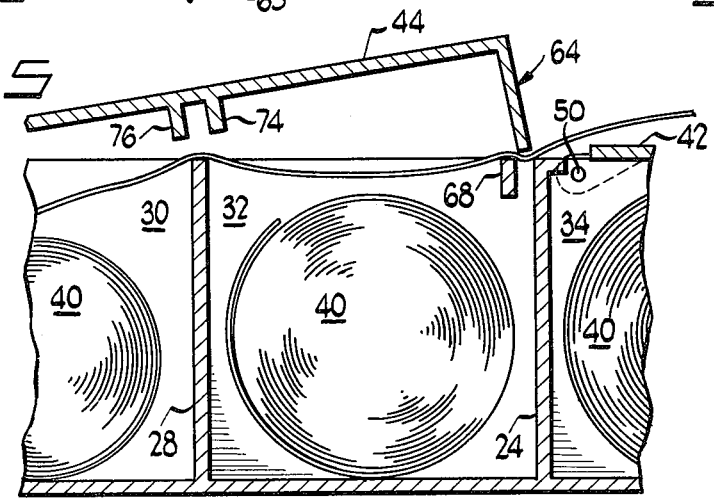
FIG. 5 is an enlarged partial cross-sectional view showing a roll of sheet material about to be cut.

The cover 42 includes a pair of parallel ribs 70 and 72 defined thereon so as to be positioned on opposite sides of the wall 26 upon complete closure of the cover 42. The ribs 70 and 72 function to hold and pinch the sheet material pulled from the roll 40 in the compartment 34 during the cutting operation of the sheet material by the cutting edge 58. The ribs 70 and 72 provide a function similar to the rib 66 in preventing a jagged or uneven cut edge of the sheet material and also frictionally secure the cover 42 in its closed position. Similarly, cover 44 includes ribs 74 and 76 that cooperate with the wall 28 in the same way that the ribs 70 and 72 cooperate with the wall 26 to insure an even cut line along the sheet material dispensed from the roll 40 in the compartment 30. As shown in FIG. 5, contact between the wall 30 and ribs 74 and 76 or between the wall 28 and ribs 70 and 72 conveniently does not occur until a short time after the cutting edge 58 contacts the sheet material and begins to enter the gap which receives the edge 58.

If desired, inserts (not shown) may be provided that engage the roll 40 ends and act as stub axles to allow rotation of the rolls 40 while preventing them from falling out of the compartments 30, 32, 34 and 36.

The dispensing device 10 provides a structure that provides a straight, even cut line in the material during dispensing. The dispensing device 10 may be placed on a counter or secured to a wall or door or similar structure for easy use. In addition, during the tearing operation, the covers 42 and 44 of the dispensing device 10 hold the rolls 40 in their respective compartments 30, 32, 34 and 36 thus preventing the rolls from popping out of their respective compartments due to the force created by the cutting operation.

Dispensing is accomplished initially with cover 44 or 42 open, by feeding the free edge of the sheet material from a compartment 30 or 34 over the wall 28 or 26 and over the rib 68 or 66, as shown in FIG. 5, until the desired length of material extends outwardly of the housing 14. The cover 44 or 42 is then closed causing the cutting edge 68 or 58 to shear the sheet material between the rib 68 and wall 24 or the rib 66 and wall 16. The sheet material is instantaneously held stationary by the pinching action supplied by the rib 68 or 66. Shortly afterward the ribs 74, 76 or 70, 72 pinch the sheet material intermediately along its extension from its roll 40, on a wall 28 or 26.

The foregoing detailed description has been given for clearness of understanding only and no unnecessary limitations should be understood therefrom as many modifications will be obvious to those skilled in the art.

What is claimed and sought to be secured by the Letters Patent of the United States is:

1. A dispenser for sheet material, comprising:
a housing having a front wall;
a compartment defined in said housing for containing a roll of said sheet material;
a rib within said compartment spaced from said front wall;
a cover for said compartment, said cover including a front edge and a rear edge, said cover pivotally mounted on said housing at said rear edge, said cover pivotable from a first position covering said compartment to a second position exposing said compartment; and
means for cutting said sheet material including a cutting edge with teeth on said cover spaced from said rear edge and arranged to cooperate with the rib and the front wall to hold and sever said sheet material as said cover pivots from said second position to said first position.

2. The dispenser claimed in claim 1 wherein said cutting edge, arranged generally parallel to the axis of rotation of said cover, comprises alternating short and long cutting teeth on said front edge of said cover.

3. The dispenser claimed in claim 1 wherein said cutting edge comprises a triangular cutting edge on said front edge of said cover, said cutting edge being serrated.

4. The dispenser claimed in claim 1 further comprising a second compartment defined by said housing, a dividing wall in said housing separating said first compartment and said second compartment, and means on said cover for holding sheet material between said dividing wall and said cover.

5. The dispenser claimed in claim 1 wherein such sheet material is pinched by the cutting edge teeth and the rib.

6. The dispenser claimed in claim 1 wherein some of the teeth are longer than other teeth and said longer teeth initially pinch and cut such sheet material.

7. A device for dispensing sheet material and the like, comprising:
a housing defining a first compartment for holding a roll of sheet material;
a first cover for said first compartment pivotally mounted on said housing for movement toward and away from said housing;
a cutting edge on said cover spaced from the point of mounting said cover on said housing for cutting said sheet material as said cover pivots toward said housing; and
means defining a slot in said housing, said means arranged to pinch the sheet material between said means and said cutting edge as said edge moves toward said housing for holding said sheet material during cutting of said sheet material by said cutting edge.

8. The device set forth in claim 7 wherein said cutting edge includes alternating short and long teeth.

9. The device set forth in claim 7 wherein said cutting edge comprises a triangular, serrated edge.

10. The device set forth in claim 7 wherein said housing defines a second compartment for holding a second roll of sheet material, and a wall in said housing between said first compartment and said second compartment engaging means on said cover for holding sheet material from said second roll of sheet material while being cut by said cutting teeth.

11. The device set forth in claim 7 wherein said cutting edge includes teeth of different lengths with the slot defining means initially pinching the sheet material between the slot defining means and the longer teeth as said cutting edge moves towards said housing.

12. A device for dispensing selected lengths of sheet material and the like, comprising:
a housing defining first and second compartments for containing first and second rolls, respectively, of continuous sheet material,
a wall defined by said housing separating said first and second compartments,
a cover pivotally mounted on said housing for covering said first and second compartments,
a cutting edge on said cover for cutting said sheet material,
means on said cover for holding sheet material from said second roll of sheet material on said wall while said cover covers said first and second compartments, and means on said housing for holding sheet material from said first roll of sheet material while said cover covers said first and second compartments.

13. The device claimed in claim 12 wherein said cutting edge comprises alternating short and long teeth.

14. The device claimed in claim 12 wherein said cutting edge comprises a triangular serrated cutting edge.

15. The device claimed in claim 12 wherein the axis of rotation of said cover is generally parallel to said cutting edge.

* * * * *